United States Patent [19]

Kuroda et al.

[11] Patent Number: 4,458,397

[45] Date of Patent: Jul. 10, 1984

[54] METHOD FOR SIMULTANEOUS SIZING OF A LARGE NUMBER OF LONG FIBER YARNS

[75] Inventors: Susumu Kuroda, Nagoya; Tadashi Komori, Fukui, both of Japan

[73] Assignee: Kawamoto Industrial Co., Ltd., Nagoya, Japan

[21] Appl. No.: 429,125

[22] Filed: Sep. 30, 1982

Related U.S. Application Data

[62] Division of Ser. No. 242,430, Mar. 11, 1981, Pat. No. 4,417,374.

[30] Foreign Application Priority Data

May 9, 1980 [JP] Japan ..... 55-61885

[51] Int. Cl.[3] ..... D02H 5/02; D02H 13/20

[52] U.S. Cl. ..... 28/181

[58] Field of Search ..... 28/180, 181, 199, 212

[56] References Cited

U.S. PATENT DOCUMENTS

| | | | |
|---|---|---|---|
| 2,438,084 | 3/1948 | Wood | 28/180 |
| 2,565,407 | 8/1951 | Still | 28/180 |
| 2,675,601 | 4/1954 | Still | 28/180 |
| 3,449,808 | 6/1969 | Kuroda | 28/180 |
| 3,466,717 | 9/1969 | Kuroda | 28/180 |
| 3,789,469 | 2/1974 | Kodama | 28/180 |

*Primary Examiner*—Robert Mackey

*Attorney, Agent, or Firm*—Koda and Androlia

[57] ABSTRACT

A method of and an apparatus for simultaneously sizing a large number of long fiber yarns, in which number of warper's beams having a sufficient number of warps for weaving of cloth is divided into 2 or 3 sets of beams according to the total number of warps and the yarn diameter so that yarns in each divided set are placed in the width equal to that of said weaver's beam having a yarn pitch of over 3 times that of the yarn diameter, each warp sheet from divided warper's beams is sized and dried passing over one of the sizing and drying paths having a same distance of 2 or 3 systems placed in vertical levels under a same amount of draft, and then each yarn which is sized and dried in each system is wound onto a weaver's beam over a path of the same distance with a same amount of draft.

1 Claim, 8 Drawing Figures

METHOD FOR SIMULTANEOUS SIZING OF A LARGE NUMBER OF LONG FIBER YARNS

This is a division of application Ser. No. 242,430 filed Mar. 11, 1981 now U.S. Pat. No. 4,417,374, issued Nov. 29, 1983.

BACKGROUND OF THE INVENTION

1. Field of the Invention

The present invention relates to a method of and an apparatus for simultaneous sizing and drying a complete number of warps which is necessary for the weaving of cloth, and winding onto a weaver's beam for long fiber yarns.

2. Prior Art

In the method of simultaneous sizing a large number of long fiber yarns of the prior art, a complete number of warps which is necessary for weaving of cloth is drawn from a necessary number of warper's beams, each sheet of warps from the warper's beams is threaded through a reed and passes over a guide roller, and the warp sheets from the warper's beams are collected into one complete sheet having a width equal to that of the beam to be sized and squeezed, and the complete warp sheet is separated again into separate warp sheets of the original warper's beams to be transfered into a hot-air drying chamber. Each warp sheet is then separated into a top warp sheet and a bottom warp sheet by a dividing guide roller provided inside the drying chamber. Then each separated warp sheet is passed inside the hot-air drying chamber so that the yarn absorbed with a sizing solution is dryed. Then each dryed warp sheet is collected onto one warp sheet again outside the hot-air drying chamber, and the warp sheet is finally wound onto a weaver's beam through the usual processes. But, in this method of sizing, no consideration is paid to the total number of warps and the diameter of the warp yarn, and the yarn density of each warp sheet is high. As a result, each warp sheet which is drawn through the reed may not align uniformly on the face of the guide roller and the warps tend to overlap each other. If this takes place, when each warp sheet is passing through the size box, the yarns may pass through overlapped to produce eneven sizing, or the yarns may be entangled with each other after reversing the contact side of the warp sheet in the process of passing through the guide roller, the immersion roller, and the squeezing rollers so that the yarns may be broken in the process of dividing the sheet after squeezing. The warp sheets pass over the guide rollers in the drying chamber and the remaining sizing solution on the guide rollers may be solidified to produce and transfer waste-size onto the yarns in contact with the guide rollers. Since this method of sizing has these stated disadvantages, long fiber yarns can not be sized satisfactorily in this method.

Therefore, the above stated method is not used for sizing of long fiber yarns. A method of sizing using pre-beams is used instead. In this method of warp sizing, a warp sheet which has a low yarn density with a yarn pitch of 1 to 2 mm is drawn from a warper's beam, the width of the warp sheet is equal to that of the warper's beam, and the drawn warp sheet with its low yarn density is sized, dryed, and wound onto a pre-beam which has the same width as that of the warper's beam. But, since this method has to size each warper's beam and make it into a pre-beam, the efficiency is not high. If the sizing speed and the drying temperature are increased to try to increase the efficiency, the time in which the yarns pass through the sizing solution is decreased to reduce the amount of applied size, and the effect of squeezing becomes poor to prevent the sizing solution from penetrating inside the yarn. As a result, no improvement in sizing efficiency can be expected. These pre-beams have to be rewound and wound again onto a weaver's beam. Also in making pre-beams, it is impossible to make all the pre-beams under the same condition. The tension of each pre-beam may become different and produce stripe marks on the woven cloth.

SUMMARY OF THE INVENTION

It is an object of the invention to provide an improved method of and an apparatus for simultaneous sizing a large number of long fiber yarns which is free of disadvantages of the prior art.

Another object of the invention is to provide a method of and an apparatus for simultaneous sizing a large number of long fiber yarns to prepare weaver's beams with high quality efficiently.

The inventors of the present invention studied the method of simultaneous sizing a large number of yarns and found out the following points.

(1) When each warp sheet drawn from a set of warper's beams having the same width as for that of the warper's beam passes through a reed and over a guide roller to be collected into one complete warp sheet to be transfered into a sizing device, if the individual yarns of each warp sheet can be positioned on the circumference of the above guide roller without overlapping, the yarns may not overlap in the process of sizing in which the collected warp sheet passes under an immersion roller which is placed inside the sizing solution of the sizing device and then passes throught a pair of squeezing rollers. Therefore, the yarns do not produce uneven sizing spots or yarn-breakages in the dividing process after squeezing.

(2) In order to position the yarns from each warp sheet on said guide roller without overlapping, the sum of all the yarn diameters of the yarns passing through the spaces between the blades of said reed from the said warper's beams should not exceed the sum of all the spaces between the blades of the reed.

(3) When taking the considerations of the yarn deformations and the vibrations which may take place when said each warp sheet passes over said guide roller to overlap the yarns, it is safe to set the number of yarns drawn from said set of warper's beams so that the yarns are positioned with a pitch of around 3 times larger than the yarn diameter within the beam width.

The present invention has been invented based on the results of the above studies.

A method of simultaneous sizing a large number of long fiber yarns provided in this invention includes the steps of:

dividing a set of warper's beams having a sufficient number of warps for weaving of cloth into 2 or 3 systems according to the total number of warps and the yarn diameter so that each system of divided warps is positioned in the width of said warper's beam having a pitch of over 3 times that of the yarn diameter, and introducing each divided warp sheet to each system of 2 or 3 sizing and drying mechanisms placed in vertical levels;

in each system, withdrawing each warp sheet from the warper's beams and passing through a reed and over a guide roller to be collected into one complete warp sheet in which the warps are positioned in a width equal to that of the warper's beam without overlapping, and sizing and squeezing the complete warp sheet;

in each system, dividing the sized and squeezed complete warp sheet into a number of separate warp sheets, the number of which is equal to that of the number of the warper's beams, having a width equal to that of the warper's beam, and dividing again each of the separate warp sheets into divided warp sheets so that the warps of the separate sheet are positioned in a divided sheet, the number of which is several times larger than the number of the warper's beams and separated vertically;

in each system, passing the divided warp sheets in which the yarns absorbed with sizing solution are separated vertically and horizontally, through hot air to dry the divided warp sheets;

in each system, collecting the divided warp sheets into one warp sheet having a width equal to that of the warper's beam to finish-dry the collected warp sheet;

applying an equal amount of draft to each warp sheet passing through an equal distance over each of the dividing path, the hot air drying path, and said finish-drying path after squeezing in each system;

after finish-drying, passing the dried warp sheets over an equal distance through a dividing path, and collecting the dried warp sheets into one warp sheet while applying an equal amount of draft, making the width of the collected warp sheet equal to that of the weaver's beam on which the warp sheet is to be wound, and winding the warp sheet onto said weaver's beam.

In this method of simultaneous sizing a large number of yarns, since a total number of warps which is necessary for weaving of cloth is divided into 2 or 3 systems, and the warps are sized and squeezed in a form of one sheet in which the yarns are not overlapped in each system, uneven sizing and yarn breakages which may be found in the method of simultaneous sizing a large number of yarns of the prior art are not produced. Since the warp sheet absorbed with sizing solution is divided before passing through hot air to be dried and the divided warp sheets do not make contact with guide rollers when passing through hot air, waste-size is not transfered to the warps, unlike the method of simultaneous sizing a large number of yarns of the prior art. Furthermore, since a total number of warps which is necessary for weaving of cloth is sized, dried, and wound onto a weaver's beam under the same working conditions, it can produce weaver's beams more efficiently without tension variations compared to the previous method of warp sizing of producing pre-beams. As a result, the method of warp sizing in this present invention can produce high-quality weaver's beams for long fiber yarns more efficiently.

An apparatus for simultaneous sizing a large number of yarns in this invention includes:

beam stand sections having several beam stands;

sizing sections having first reeds; guide rollers; sizing devices which have immersion rollers to immerse warps in sizing solution and squeezing rollers;

wet dividing sections having a number of dividing water pipes which is one less than a multiple number of several times that of the number of the beam stands a half of the dividing water pipes is spaced almost evenly extending upwards diagonally from a base-end water pipe and another half of said dividing water pipes is spaced almost evenly extending downwards diagonally also from the base-end water pipe;

hot air drying sections having second reeds and hot air drying chambers in which hot air generating devices are incorporated;

cylinder drying sections having heating cylinders and guide rollers placed in front of and in back of said heating cylinders; two or three systems of warp sizing and drying mechanisms in which the relative positions of the sizing sections, said wet dividing sections, the hot air drying sections, and said cylinder sections are placed almost identically and vertically; a winding section having an adjustable reed and a winding device which comprises a measuring roller, a beaming roller, and a driving shaft for a weaver's beam;

a dividing section having dividing rods positioned between the cylinder drying section and the winding section of said warp sizing and drying mechanism in each system, the length of the dividing section being equal for each section;

a driving motor which is connected to the beaming roller of the winding section through a transmitting shaft;

the driving motor being connected through a draft adjusting device to the heating cylinders of each system by transmitting shafts;

and the heating cylinders are connected through a draft adjusting device to the squeezing rollers of each system by transmitting shaft.

This apparatus for simultaneous sizing a large number of yarns can be adapted to use the method of simultaneous sizing of a large number of long fiber yarns provided by this invention to produce high-quality weaver's beams efficiently.

DETAILED DESCRIPTION OF THE INVENTION

First Example of the Embodiments (FIG. 1 to FIG. 7)

The first example of the embodiments of this invention is an example in which the yarn pitch of the warps drawn from a total number of warper's beams having sufficient number of warps for weaving of cloth in the same width as for that of the warper's beam is less than 3 times that of the yarn diameter but the yarn pitch becomes more than 3 times that of the yarn diameter when the warps are drawn from a half of the total number of warper's beams in the same width as for that of the warper's beam.

Figure 1:
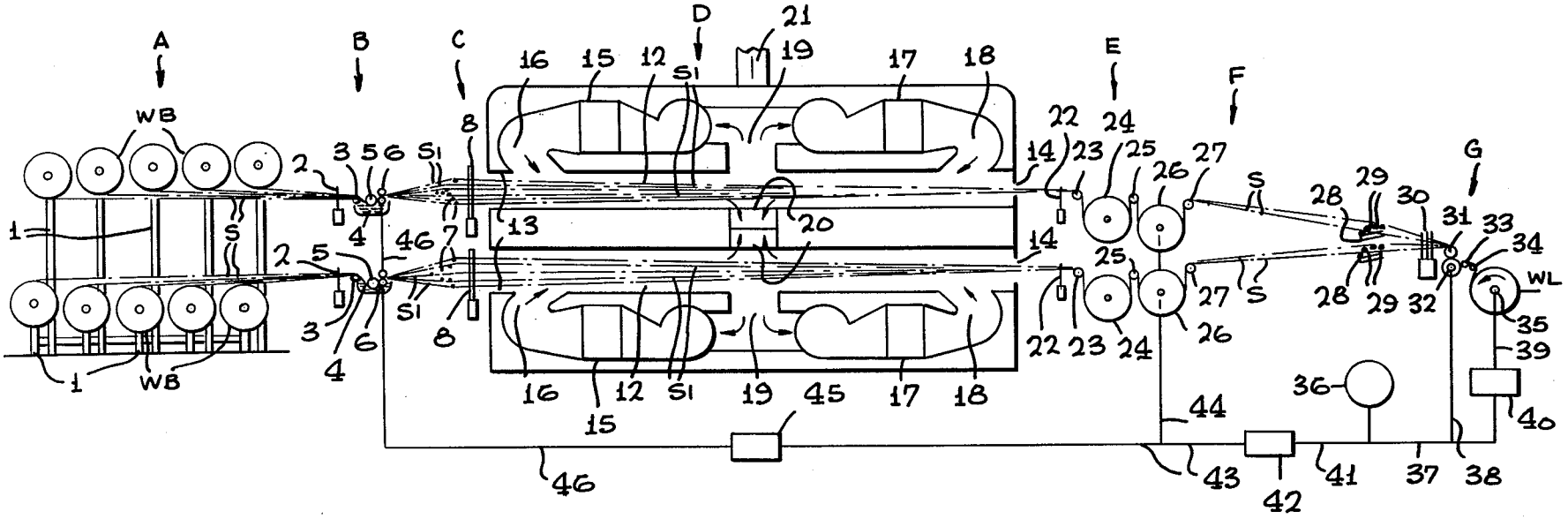
FIG. 1 shows a schematic side view of an apparatus for simultaneous sizing a large number of yarns of the first embodiment of this invention.

An apparatus for simultaneous sizing a large number of yarns in the first embodiment comprises two systems of a warp sizing and a drying mechanism having a beam stand section (A), a sizing section (B), a wet dividing section (C), a hot air drying section (D), and a cylinder drying section (E); one system being placed on top of the other. Identical sizing sections (B), wet dividing sections (C), and cylinder drying sections (E) are positioned in the top system and the bottom system, as shown in FIG. 1. Symmetrical hot air drying sections (D) excluding second reeds (8) are positioned in the top system and the bottom system. The relative positions of the sizing section (B), the wet dividing section (C), the hot air drying section (D), and the cylinder drying section (E) of each system are equal. The length of the yarn path between the sizing section (B) and the cylinder drying section (E) including the lengths of two sections for each system is made equal. There are two dividing sections (F) between the warp sizing the drying mechanism of each system and a winding section (G); the distance of the section is equal for both dividing sections.

In using this apparatus, an even number of warper's beams having a sufficient number of long fiber warp yarns for weaving of cloth is divided into two. One half of divided warper's beams (WB) in an odd number is rotatably mounted on each beam stand (1) of the beam stand section of the warp sizing and drying mechanism of the top system, and the other half of divided warper's beams (WB) is rotatably mounted on each beam stand (1) of the beam stand section of the warp sizing and drying mechanism of the bottom system; a same odd number of warper's beams (WB) is positioned in the warp sizing and drying mechanism of each system on top and bottom.

Warp sheets (S) are withdrawn from the warper's beams (WB) of each system in a width equal to that of the warper's beam, these sheets (S) are transfered to the sizing section (B), and each single yarn of the warp sheets (S) is drawn through the blades of angle reeds of the first reed (2), each warp sheet (S) is then drawn through the first reed (2) and over the guide roller (3), each warp sheet (S) withdrawn from the warper's beams (WB) is collected into one sheet, the collected sheet in the width equal to that of the warper's beam in which the yarns are positioned on the circumference of the guide roller (3) without overlapping is introduced to a sizing solution (4) of a size box of the sizing device, the warp sheet then goes under an immersion roller (5) which is placed in the sizing solution and through the sizing solution (4), the yarns in the sheet are attached with the sizing solution and pass through a top and a bottom roller of the squeezing rollers (6), and the yarns are squeezed by the squeezing rollers (6) so that the sizing solution is absorbed in the yarns.

Then, the warp sheet which has absorbed the sizing solution and squeezed in one sheet is introduced into the wet dividing section (C) where the warp sheet is divided into the original warp sheets of the warper's beams, and each divided warp sheet is divided again into an even number of warp sheets (S1) in which the yarns of every odd number of yarns in the original warp sheets of the warper's beams are placed side by side.

Figure 2:
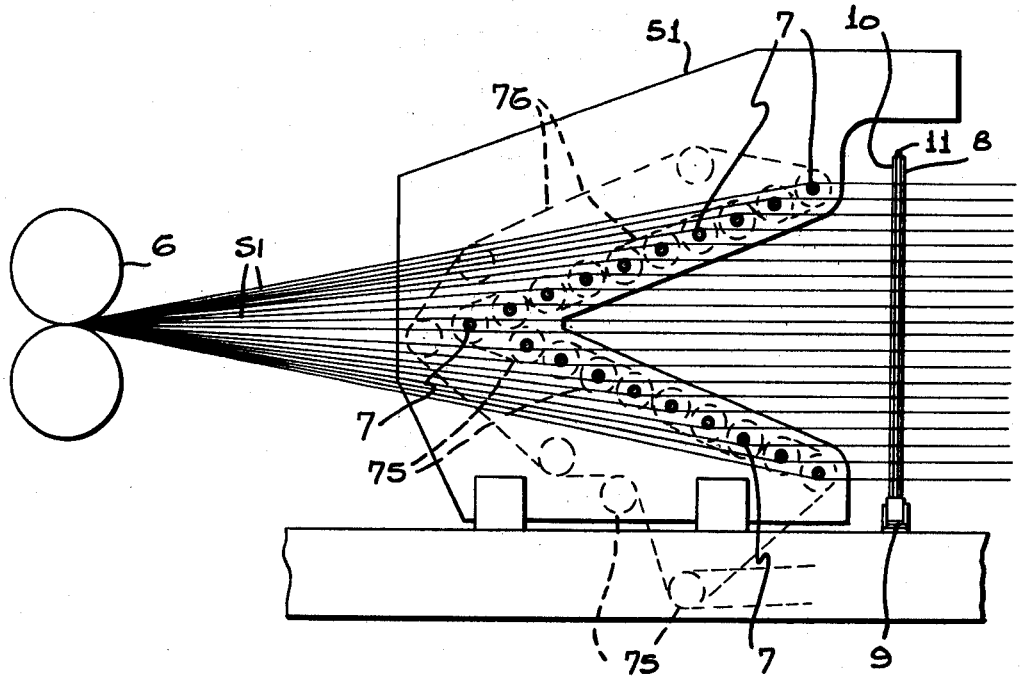
FIG. 2 shows an enlarged side view of a wet dividing section of the apparatus for simultaneous sizing a large number of yarns.

As shown in FIG. 2, the wet dividing section (C) comprises dividing water pipes, the number of which is one less than the number of the divided warp sheets (S1), a half of the dividing water pipes are positioned evenly extending diagonally upwards from a base-end dividing water pipe (7) which is positioned at the same height as that of the nip point of the squeezing rollers (6) and another half of the dividing water pipes is positioned evenly extending diagonally downwards from the base-end dividing water pipe (7). Each divided warp sheet (S1) goes over or under each dividing water pipe (7) or over and under the base-end dividing water pipe (7) so that the divided warp sheets (S1) are separated vertically, the divided warp sheets make contact with the surfaces of the dividing water pipes which are moist due to the condensation of the moisture inside the atmosphere by the cooling effect of the water which passes inside the dividing water pipes (7), and each divided warp sheet (S1) is introduced to the hot air drying section (D).

The second reed (8) of the hot air drying section (D) comprises short blades (10) and long blades (11) which are positioned alternatively on a reed stand (9) with a blade pitch which is twice of that of the first reed (2). Each yarn from top and bottom divided warp sheets leaving one divided warp sheet in between from the even number of divided warp sheets (S1) which are separated vertically from the same warp sheet is drawn between the short blades (10) and the long blades (11) of the second reed, all divided warp sheets (S1) are drawn through the second reed (8) in this manner, and each divided warp sheet (S1) is separated vertically and horizontally to be introduced to a hot air drying chamber (12) through an inlet mouth (13).

The yarns in the top system are dried by passing through two systems of circulating hot air at the back half and the front half of the hot air drying chamber. The system of circulating hot air at the back half of the hot air drying chamber comes from a hot air generating device (15) situated on the back of the ceiling of the hot air drying chamber (12) through a blow mouth (16) which is opened in the back of the ceiling, the circulating hot air is then blown down diagonally towards the center of the hot air drying chamber from the blow mouth (16) and is circulated back to the hot air generating device (15) through a common suction mouth (19) which is provided at the center of the ceiling surface; and the system of circulating hot air at the front half of the hot air drying chamber comes from a hot air generating device (17) situated on the front of the ceiling of the hot air drying chamber (12) through a blow mouth (18) which is opened in the front of the ceiling, the circulating hot air is then blown down diagonally towards the center of the hot air drying chamber from the blow mouth (18) and is circulated back to the hot air generating device (17) through the common suction mouth (19). The yarns in the bottom system are dried by passing through two systems of circulating hot air at the back half and the front half of the hot air drying chamber which is symmetrical to that of the top system: the system of circulating hot air at the back half of the hot air drying chamber comes from a hot air generating device (15) situated on the back of the floor of the hot air drying chamber (12) through a blow mouth (16) which is opened on the back of the floor, the circulating hot air is then blown up diagonally towards the center of the hot air drying chamber from the blow mouth (16) and is circulated back to the hot air generating device (15) through a common suction mouth (19) which is provided at the center of the floor surface; and the system of circulating hot air at the front half of the hot air drying chamber comes from a hot air generating device (17) situated on the front of the floor of the hot air drying chamber (12) through a blow mouth (18) which is opened on the front of the floor, the circulating hot air is then blown up diagonally towards the center of the hot air drying chamber from the blow mouth (18) and is circulated back to the hot air generating device (17) through the common suction mouth (19). In drying, some of moist hot air is exhausted outside from an exhaust mouth (20) which is opened at the center of the floor or the ceiling of the hot air drying chamber of each system through an exhaust pipe (21). Each divided warp sheet (S1) which is dried in the hot air drying chamber (12) is transfered to the cylinder drying section (E) through the outlet mouth (14) which is positioned at the front of the hot air drying chamber (12). Then each divided warp sheet is collected into one sheet through a third reed (22) and over a guide roller (23), and the collected warp sheet is finish-dried by passing under a heating cylinder (24), over an intermediate guide roller (25), and under another heating cylinder (26).

The warp sheets which pass over the same path with the same distance from the squeezing rollers (6) of the sizing section to the heating cylinder (26) of the cylinder drying section in either of the systems are stretched with a same amount of draft created by the difference of the feed speeds of the squeezing roller (6) and the heating cylinder (26), two of which are connected through a transmitting shaft (46), a draft adjusting device (45), a transmitting shaft (43), and a transmitting shaft (44); in case of a synthetic yarn, the yarn is shrunk by heat with a negative draft. The collected warp sheet which is finish-dried over the heating cylinder (26) is passed over a guide roller (27) and transfered to the dividing section (F). The collected warp sheet is divided again into the original warp sheets of the warper's beams, and divided warp sheets are separated vertically by dividing rods (29), the number of which is one less than the number of warper's beams (WB), the dividing rods (29) are detachably mounted on support frames (28) of the dividing section, and each warp sheet from both systems is transfered to the winding section (G). Each warp sheet of both systems is drawn through an adjustable reed (30), and the width of the warp sheet is adjusted equal to that of the weaver's beam (WL), and all the warp sheets of both systems which are sized and dried are collected into one warp sheet passing over a measuring roller (31), then the collected warp sheet is transfered to a beaming roller (32) which is rotated by a motor (36) through a transmitting shaft (37) and a shaft (38), and the warp sheet passes under the beaming roller (32).

Each warp sheet passing over the path with the same distance from the guide roller (27) to the measuring roller (31) in each system is stretched with a suitable amount of draft adjusted by the draft adjusting device (42) and created by the difference of the feed speeds of the beaming roller (32) and the heating cylinder (26) of each system which is rotated by the motor (36) through a transmitting shaft (41), the draft adjusting device (42), a transmitting shaft (43), and a transmitting shaft (44). Then the sized and collected warp sheet passes under the beaming roller (32) and over guide rollers (33) and (34) and is transfered to the weaver's beam (WL). Finally, a wound weaver's beam is produced by winding the total number of long fiber warp yarns in one sheet having a sufficient number of warps for weaving of cloth which are sized and dried separately in two systems on the weaver's beam (WL) in a width equal to that of the weaver's beam; the weaver's beam is rotated by a driving shaft (35) for the weaver's beam which is rotated by the motor (36) through a transmitting shaft (37), a winding speed changing device (40), and a transmitting shaft (39).

Figure 3:
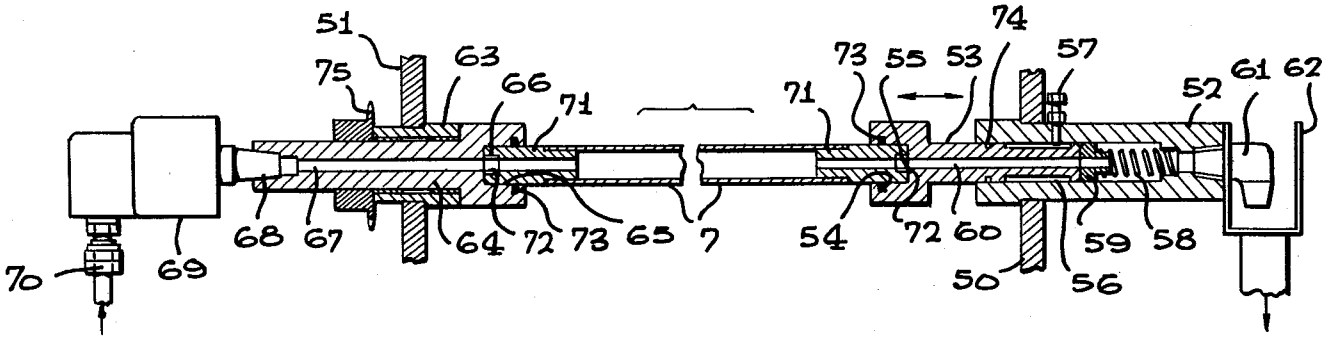
FIG. 3 shows an enlarged cross sectional view of a dividing water pipe being mounted in the wet dividing section.
Figure 4:
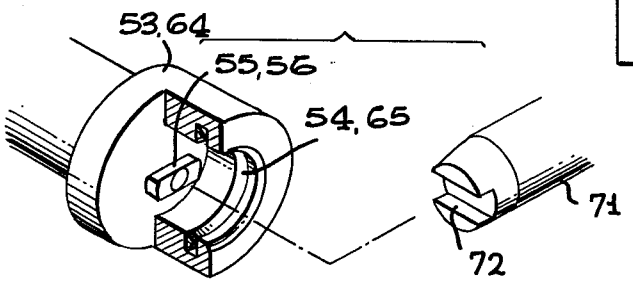
FIG. 4 shows an enlarged perspective view of a connecting section of the dividing water pipe.

The support condition of the dividing water pipes (7) of the wet dividing section (C) is shown in FIG. 3 and FIG. 4. A sliding support bracket (53) which has an extending head with a fit hole (54) on its end surface is slidably fit inside a pipe bracket (52) mounted through a frame (50). The center of a bolt (57) threaded through the pipe bracket (52) is placed inside the caved-in place (56) which is provided on the outer surface of the sliding support bracket (53). A support piece (59) in the form of a short cylinder makes contact with the inside end face of the sliding support bracket (53) and presses a spring (58) which is mounted on its end between the inside end face of the sliding support bracket (53) which is slideably fit inside the pipe bracket (52) and the step section inside the hole of the pipe bracket (52). The support piece (59) pushes the sliding support bracket (53) towards the center of two frames (50) and (51) on the right and left to a position where the bolt (57) makes contact with the end of the caved-in section of the sliding support bracket (53) to stop the bracket (53). The head section with the fit hole (54) of the sliding support bracket (53) is thus extended further inside than the end face of the pipe bracket (52) which is also extending inside from the inside surface of the frame (50).

A fitting projection (55) is provided on the center of the inside bottom surface of the fit hole (54) of the sliding support bracket, a water-proof seal (73) is provided in the inside surface of the fit hole (54), a water-proof O-ring (74) is provided on the outside surface of the sliding support bracket (53) which slideably fits inside the hole of the pipe bracket (52), a part of an elbow pipe (61) is inserted in the outside end face of the pipe bracket (52) so that the hole of the pipe bracket is connected to that of the elbow pipe, the other end of the elbow pipe extends inside an exhaust channel (62), and a water path (60) which runs through the center of the sliding support bracket (53) is connected to the hole of the pipe bracket in which the spring (58) is inserted through the support piece (59).

A cylindrical rotating support bracket (64) which has an extending head with a fit hole (65) on its end surface is supportably inserted in a bearing (63) mounted through the other frame (51). The extending head of the rotating support bracket (64) makes contact with the inside end face of the bearing (63). A sprocket wheel (75) is mounted on the rotating support bracket (64) at a position where the sprocket wheel makes contact lightly with the outside end face of the bearing (63) so that the rotating support bracket (64) is secured to the bearing (63). The rotating support bracket (64) is mounted in the opposite position from that of the sliding support bracket (53).

A fitting projection (66) is provided on the center of the inside bottom surface of the fit hole (65) of the rotating support bracket (64), a water-proof seal (73) is provided in the inside surface of the fit hole (65), and a connecting pipe (68) which is connected to a water path (67) running through the center of the rotating support bracket (64) is rotatably supported by a square water pipe (69) which is connected to a water supplying pipe (70).

A fitting bracket (71) which has a fitting groove (72) on its end face is inserted on each end of the dividing water pipe (7). The dividing water pipe (7) is mounted in the following method: the end section of the fitting bracket (71) on one end of the water dividing pipe (7) is inserted in the fit hole (54) of the sliding support bracket (53), the fitting groove (72) is fitted over the fitting projection (55) on the bottom surface of the fit hole, the end section of the fitting bracket (71) of the dividing water pipe is pressed inside the fit hole (54) to be connected to the head section of the sliding support bracket, the sliding support bracket (53) slides out against the spring (58) and the dividing water pipe (7) is also moved towards the frame (50) so that the end section of the fitting bracket (71) on the other end of the dividing water pipe can be moved to a position where it can be inserted in the fit hole (65) of the rotating support bracket (64). Then by releasing the pressure of the dividing water pipe (7) towards the frame (50), the sliding support bracket (53) moves inside by the reaction of the spring (58). The dividing water pipe (7) is also moved to insert the end section of the fitting bracket (71) on the other end of the dividing water pipe in the fit hole (65) of the rotating support bracket (64), the fitting groove on the end of the fitting bracket is fitted over the fitting projection (66) of the fitting hole, the dividing water pipe (7) is securely supported between the sliding support bracket (53) and the rotating support bracket (64) by the pressure of the spring (58), and the dividing water pipe (7) is connected to the water ways (60) and (67) of both support brackets and the connection is made water-tight by the water-proof seals (73).

The dividing water pipe (7) is removed in the reverse order. Since the dividing water pipes (7) can be removed and mounted easily as explained above, the operation of threading yarns to this apparatus of simultaneous sizing a large number of yarns is made easy, and the amount of work and the time for the threading operation is saved.

As shown by the broken lines in FIG. 2, a chain (76) is placed over each sprocket wheel (75) on each rotating support bracket (64), and the chain is maintained in a loop with additional auxiliary sprocket wheels (75'), the lowest auxiliary sprocket wheel (75') is rotated slowly by a motor (not shown in the diagram) to drive the chain (76), and the rotating support brackets (64) rotate to rotate the dividing water pipes (7) slowly with the sliding support brackets (53) so that the position on the circumference of the dividing water pipe where the yarn absorbed with the sizing solution makes contact is moving all the time. Therefore, unlike the case in which the yarn absorbed with the sizing solution makes contact on a fixed position continuously on the circumference of the dividing water pipe, the solidification of the sizing solution on the surface of the dividing water pipe is decreased because the sizing solution is diluted all the time by the water condensed on the surface of the dividing water pipe. As a result, the concentration of the sizing solution on the surface of the dividing water pipe does not increase and the sizing is prevented from solidifying and the formation of waste size is prevented.

Figure 5:
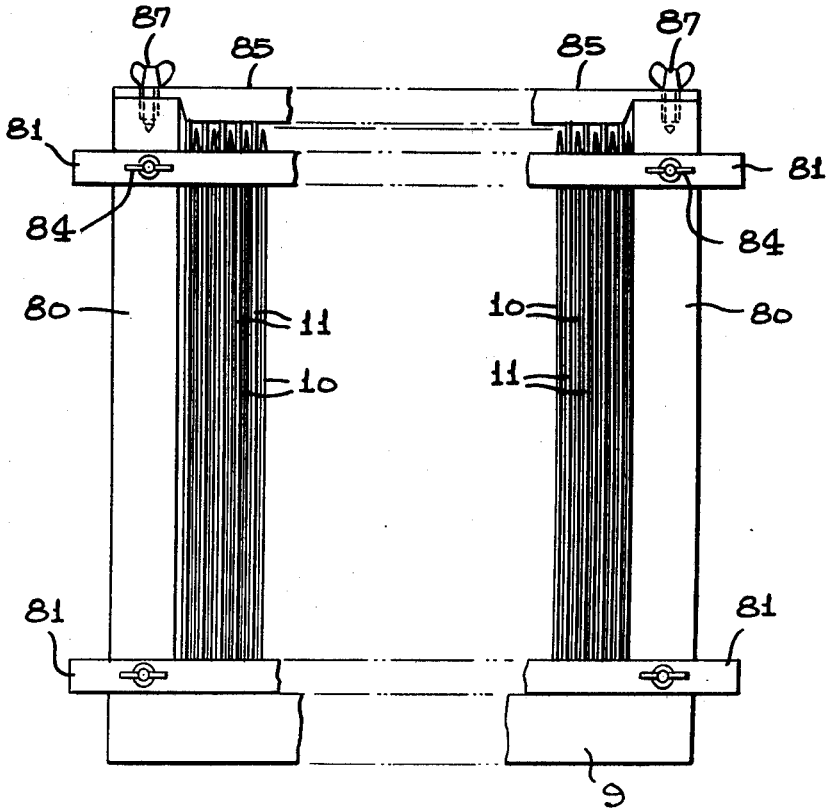
FIG. 5 shows an enlarged front view of a second reed of the apparatus for simultaneous sizing a large number of yarns, the center section of which is omitted from the drawing.
Figure 7:
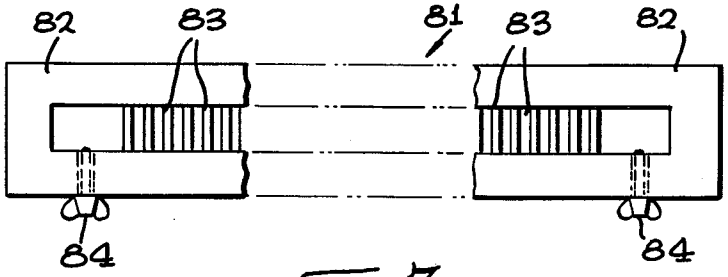
FIG. 7 shows a top view of a reed blade spacing device of the second reed, the center section of which is omitted from the drawing.
Figure 6:
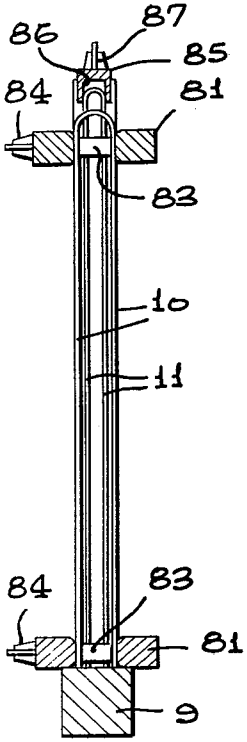
FIG. 6 shows a cross sectional side view of the second reed.

FIG. 5 to FIG. 7 show the details of the second reed (8). The second reed (8) comprises a reed main body, two reed blade spacing devices (81), and a reed blade anti-vibration device (85). The reed main body contains short and wide U-shaped reed blades (10) and long and narrow U-shaped reed blades (11) both of which are made by bending wires or pipes in half and making the sides parallel. The short blades (10) and the long blades (11) are planted on the reed stand (9) alternatively with the blade pitch which is twice larger than that of the first reed (2) with the plane of the U-shaped face being perpendicular to the lengthwise direction of the reed stand and with the bending ends of the blades (10) and (11) being placed on top, both sides of the reed blades (10) extending from both sides of the reed blades (11). Support posts (80) which have the same width as for that of the U-shaped reed blades (10) are provided on both ends of the reed stand (9) and the side faces of the support posts and the reed blades (10) are aligned.

As shown in FIG. 7, the reed blade spacing device (81) contains spacing pieces (83) positioned in the direction of the shorter sides across the frame with the pitch equal to that of the reed blades to be inserted between the reed blades (10) and (11) inside a rectangular frame (82). Stop screws (84) are threaded through to inside on both ends of the side face of a longer side of the rectangular frame (82). The rectangular frame (82) is placed over the support posts (80) which are positioned on both ends of the reed stand (9) to fit over the outsides of the reed blades (10), each spacing piece (83) is inserted between the reed blades (10) and the reed blades (11), each stop screw (84) is tuned in so that its tip is pressing the face of each support post (80) to fix the rectangular frame (82) to the support posts (80).

When all divided warp sheets (S1) are drawn through the reed (8), the reed blade spacing devices (81) are positioned above and below all drawn divided warp sheets so that the reed blades are positioned with an even pitch and vibration in the front-to-back direction of each reed blade (10) is prevented. As shown in FIG. 5 and FIG. 6, the reed blade anti-vibration device (85) has an inserting groove (86) at the center of the lower face and butterfly bolts (87) which are freely inserted through holes on both ends. The reed blade anti-vibration device (85) is mounted on the support posts (80) by fixing both ends on the support posts by screwing the butterfly bolts (87) so that the bending sections of the reed blades (11) which are placed parallel extending above the reed blades (10) are inserted in the inserting groove (86) of the reed blade anti-vibration device (85) to prevent the reed blades (11) from vibrating in the front-to-back direction.

This reed (8) has been invented since all the previous types of reeds can not be used because the vertical length in which the divided warp sheets (S1) pass is long and even if long reed blades are used, they will deflect and produce vibrations.

The following table shows a comparison of the technical data between the methods of simultaneous sizing a large number of yarns of this invention and the prior art.

| | Example 1 Polyester, 50d/24f, 250 T/M, Special cross section yarn (Total number of warps: 10,620) | | Example 2 Polyester, 60d, 300 T/M, Polyester Mixcel (Total number of warps: 7,932) | |
|---|---|---|---|---|
| | This invention | Prior art | This invention | Prior art |
| Number of warper's | 10 | (10) | 8 | (8) |

-continued

| | Example 1 Polyester, 50d/24f, 250 T/M, Special cross section yarn (Total number of warps: 10,620) | | Example 2 Polyester, 60d, 300 T/M, Polyester Mixcel (Total number of warps: 7,932) | |
|---|---|---|---|---|
| | This invention | Prior art | This invention | Prior art |
| beams (pre-beams) | | | | |
| Number of warps to be sized | 10,620 | 1,062 | 7,932 | 991.5 (average) |
| Sheet width for sizing and drying | 1,627 mm | 1,627 mm | 1,627 mm | 1,627 mm |
| Yarn pitch in sizing (yarn diameter) (mm) | 0.31 (0.088) | 1.53 | 0.41 (0.097) | 1.64 |
| Warp length (M) | 36,000 | 120,000 | 18,750 | 75,000 |
| Operation speed (M/min) | 25 | 80 | 16 | 60 |
| Running hours (H) | 25.1 | 25.5 | 20.5 | 21.2 |
| Cut length (M) (M per 2 pieces) | 56 | 56 | 63 | 63 |
| Total number of 2 pieces | 625 | 213 | 288 | 142 |
| Preparation time (H) | 6.5 | 1 | 5.5 | 1 |
| Efficiency (number of 2 pieces per hour) | 19.8 | 8.0 | 11.1 | 6.4 |

As can be seen clearly from this table, the method of simultaneous sizing a large number of yarns provided by this invention can produce weaver's beams of long fiber yarns more efficiently than the previous methods of the prior art. The examples given for the previous methods are only up to the process of making pre-beams, and an additional operation of winding weaver's beams from a certain number of pre-beams will be necessary.

Figure 8:
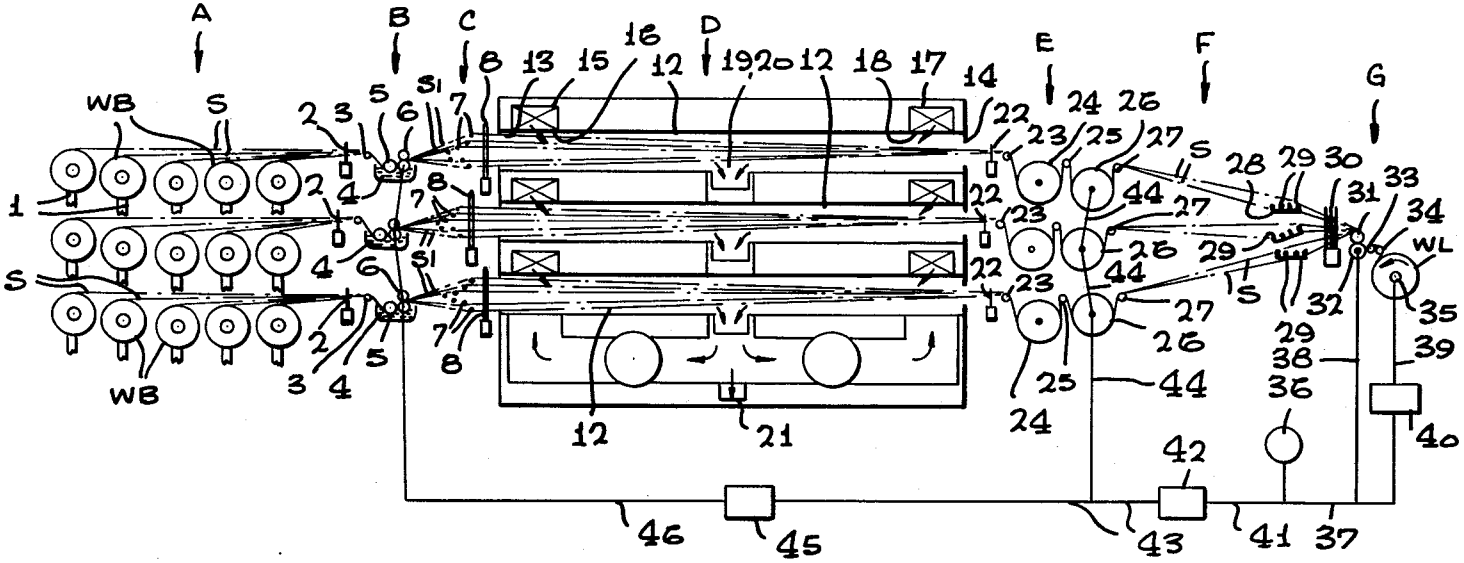
FIG. 8 shows a schematic side view of an apparatus for simultaneous sizing a large number of yarns of the second embodiment of this invention.

Second Example of the Embodiments (FIG. 8)

The second example of the embodiments of this invention is an example in which the yarn pitch of the warps drawn from ½ of a total number of warper's beams having sufficient number of warps for weaving of cloth in the same width as for that of the warper's beam is less than 3 times that of the yarn diameter but the yarn pitch becomes more than 3 times that of the yarn diameter when the warps are drawn from ⅓ of the total number of warper's beams in the same width for that of the warper's beam.

As shown in FIG. 8, an apparaus for simultaneous sizing a large number of yarns in the second embodiment comprises three systems of a warp sizing and drying mechanism having a beam stand section (A), a sizing section (B), a wet dividing section (C), a hot air drying section (D), and a cylinder drying section (E); the three systems being positioned in parallel vertically as the top system, the middle system, and the bottom system. Identical sizing sections (B), wet dividing sections (C), cylinder drying section (E), and almost identical hot air drying sections (D) are positioned in the top, the middle, and the bottom systems. The relative positions of the sizing section (B), the wet dividing section (C), the hot air drying section (D), and the cylinder drying section (E) of each system are almost equal. The length of the yarn path between the sizing section (B) and the cylinder drying section (E) including the length of two sections for each system is made equal. There are three dividing sections (F) provided between the warp sizing and drying mechanism of each system and a winding section (G); the distance of each section (F) is equal.

The structures of the sections (A), (B), (C), (D), (E), (F), and (G) of the second embodiment are substantially the same as those of the apparatus given in the first example of the embodiments. The components of the second embodiment equivalent to those of the first embodiment are shown with the same codes in FIG. 8 and the descriptions of these components are omitted.

The method of using this apparatus is similar to that of the first example of the embodiments.

A number of warper's beams having a sufficient number of long fiber warp yarn for weaving of a cloth is divided into 3 sets of a multiple number of beams. Each set of divided warper's beams (WB) is mounted on the warp sizing and drying mechanism of each system.

Warp sheets (S) are withdrawn from the warper's beams (WB) in the beam stand section (A) in a width equal to that of the warper's beam and passed through the first reed (2) of the sizing section (B) and over the guide roller (3) to be collected into one warp sheet, in each system. Each collected warp sheet in which the yarns are aligned without overlapping is sized and squeezed in the sizing section (B) of each system. Then the collected warp sheet which is sized and squeezed in one sheet is introduced to the wet dividing section (C) where the collected warp sheet is divided into the original warp sheets of the warper's beams and each divided warp sheet is divided again into a number of warp sheets (S1) in which the yarns in the original warp sheets of the warper's beams are placed side by side by the dividing water pipes (7), in each system. The yarns which are sized, squeezed, and separated vertically and horizontally are dried by passing them through the second reed (8) and the hot air drying chamber (12) of the hot air drying section (D). Each divided warp sheet (S1) which is dried is drawn through the third reed (22) of the cylinder drying section (E) and over the guide roller (23) to be collected into one warp sheet having the width equal to that of the warper's beam. The collected warp sheet is finish-dried by passing under the heating cylinder (24), over the intermediate guide roller (25), and under the heating cylinder (26). Each warp sheet passing over the wet dividing section (C), the hot air drying section (D), and the cylinder drying section (E) after squeezing of each system is stretched with a same amount of draft created by the difference of the feed speeds of the squeezing rollers (6) and the heating cylinder (26) of each system. After the finish-drying, the warp sheet past the guide roller (27) of the cylinder drying section (E) is divided into the original warp sheets (S) of the warper's beams (WB) by the dividing rods (29), in each system. The divided warp sheets (S) of each system are drawn through the adjustable reed (30) of the winding section (G), and the width of these warp sheets is adjusted to be that of the weaver's beam (WL), and the divided warp sheets are passed over the measuring roller (31) to be collected into one warp sheet. Then the collected warp sheet passes under the beaming roller (32) and over the guide rollers (33) and (34) to be wound onto the weaver's beam (WL).

Each warp sheet passing through the dividing section (F) after the finish-drying of each system is stretched with the same amount of draft which is created by the difference of the feed speeds of the heating cylinder (26) of each system and the beaming roller (32).

What we claim is:

1. A method of simultaneously sizing a large number of long fiber yarns, including the steps of:

dividing a set of warper's beams having a sufficient number of warps for weaving of cloth into at least two systems according to the total number of warps and the yarn diameter so that each system of divided warps is positioned in the width of said warper's beam having a pitch of over three times that of the yarn diameter, and introducing each divided warp sheet to each system of at least two sizing and drying mechanisms placed in vertical levels;

in each system, withdrawing each warp sheet from said warper's beams and passing through a reed and over a guide roller to be controlled into one complete warp sheet in which the warps are positioned in a width equal to that of said warper's beam without overlapping, and sizing and squeezing said complete warp sheet;

in each system, dividing said sized and squeezed complete warp sheet into a number of separate warp sheets, the number of which is equal to that of the number of said warper's beams, having a width equal to that of said warper's beam, and dividing again each of said separate warp sheets so that the warps of each said separate sheet are positioned in a divided sheet, there being a number of divided warp sheets, the number of which is several times larger than the number of said warper's beams, which divided sheets are separated vertically;

in each system, passing said divided warp sheets in which the yarns absorbed with sizing solution are separated vertically and horizontally, through hot air to dry said divided warp sheets;

in each system, collecting said divided warp sheets into one warp sheet having a width equal to that of said warper's beam to finish-dry said collected warp sheet;

applying an equal amount of draft to each warp sheet passing through an equal distance over each said dividing path, said hot air drying path, and said finish-drying path after squeezing in each system;

after finish-drying, passing said dried warp sheets over an equal distance through a dividing path of each system, and collecting said dried warp sheets into one warp sheet with application of an equal amount of draft, making the width of said collected warp sheet equal to that of the weaver's beam on which said warp sheet is to be wound; and winding said warp sheet onto said weaver's beam.

* * * * *